US011044981B2

(12) United States Patent
Cabon

(10) Patent No.: US 11,044,981 B2
(45) Date of Patent: Jun. 29, 2021

(54) APPLICATOR FOR APPLYING A COSMETIC PRODUCT TO KERATINOUS MATERIALS

(71) Applicant: L'OREAL, Paris (FR)

(72) Inventor: Chloe Cabon, Saint Ouen (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/344,147

(22) PCT Filed: Nov. 16, 2017

(86) PCT No.: PCT/EP2017/079513
§ 371 (c)(1),
(2) Date: Apr. 23, 2019

(87) PCT Pub. No.: WO2018/091611
PCT Pub. Date: May 24, 2018

(65) Prior Publication Data

US 2020/0069031 A1 Mar. 5, 2020

(30) Foreign Application Priority Data

Nov. 17, 2016 (FR) ..... 1661135

(51) Int. Cl.
*A45D 33/00* (2006.01)
*A45D 40/26* (2006.01)
(Continued)

(52) U.S. Cl.
CPC ..... *A45D 40/262* (2013.01); *A45D 34/046* (2013.01); *A45D 2040/0006* (2013.01);
(Continued)

(58) Field of Classification Search
CPC .... A46B 2200/1046; A46B 2200/1053; A46B 2200/106; A45D 40/262; A45D 34/046
(Continued)

(56) References Cited

U.S. PATENT DOCUMENTS

2004/0258454 A1 12/2004 Ramet
2006/0249168 A1 11/2006 Smit
(Continued)

FOREIGN PATENT DOCUMENTS

EP 1 229 810 B1 12/2004
EP 1 623 650 A2 2/2006
(Continued)

OTHER PUBLICATIONS

International Search Report dated Jan. 2, 2018 in PCT/EP2017/079513 filed on Nov. 16, 2017.
(Continued)

*Primary Examiner* — Jennifer C Chiang
(74) *Attorney, Agent, or Firm* — Oblon, McClelland, Maier & Neustadt, L.L.P.

(57) ABSTRACT

An applicator (3) for applying a cosmetic product to human keratinous materials, comprises a stem (4) and an applicator member (6) fixed to the stem (4), the applicator member (6) comprising a body comprising a first and a second branch each extending away from the stem obliquely with respect to the longitudinal axis of the stem and diverging outward from one another and being connected by a third branch at their end, this third branch extending obliquely with respect to the longitudinal axis (X) of the stem (4), the first, second and third branches between them forming a cavity (28).

18 Claims, 3 Drawing Sheets

Figure 1:
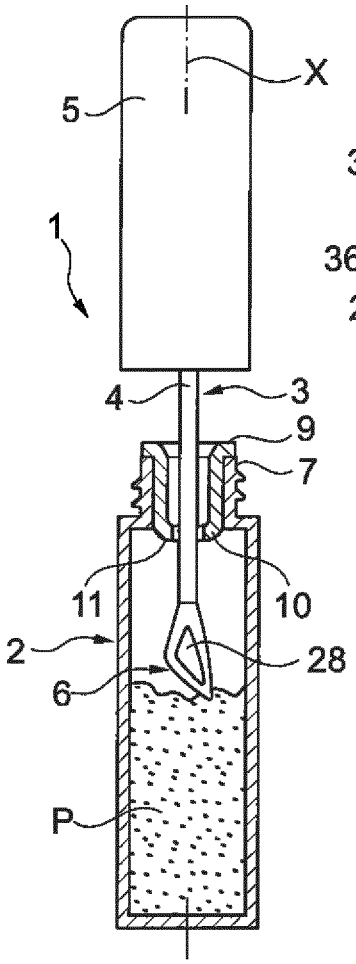

(51) Int. Cl.
*A45D 34/04* (2006.01)
*A45D 40/00* (2006.01)

(52) U.S. Cl.
CPC ..... *A45D 2200/054* (2013.01); *A45D 2200/1072* (2013.01); *A46B 2200/1053* (2013.01)

(58) Field of Classification Search
USPC ..... 401/126, 130
See application file for complete search history.

(56) References Cited

U.S. PATENT DOCUMENTS

| | | | | |
|---|---|---|---|---|
| 2017/0215555 | A1* | 8/2017 | Fogueteiro | A45D 40/00 |
| 2018/0146767 | A1* | 5/2018 | Prade | A45D 40/262 |
| 2019/0239622 | A1* | 8/2019 | Silverberg | A45D 34/045 |

FOREIGN PATENT DOCUMENTS

| | | | |
|---|---|---|---|
| EP | 2 878 223 | A1 | 6/2015 |
| FR | 2 933 281 | A1 | 1/2010 |
| FR | 2 971 923 | A1 | 8/2012 |
| JP | 2013-81661 | A | 5/2013 |
| JP | 2015-126822 | A | 7/2015 |

OTHER PUBLICATIONS

French Preliminary Search Report dated Oct. 17, 2017 in French Application 16 61135 filed on Nov. 17, 2016.

* cited by examiner

APPLICATOR FOR APPLYING A COSMETIC PRODUCT TO KERATINOUS MATERIALS

The present invention relates to applicators for applying a cosmetic product to human keratinous materials and more particularly, but not exclusively, to applicators for applying eyeliner, a product to the lips and/or to the eyebrows, eyeshadow, mascara or nail varnish. The invention also relates to a corresponding packaging and application device and to a corresponding makeup method.

Among known devices for applying eyeliner, some have a container provided with a threaded neck on which there can be fixed a closure cap which carries a stem provided at its end with an applicator end piece that is generally produced by injection-molding thermoplastic material with a flocked coating. A wiping member is usually positioned in the neck in order to wipe off the stem and reduce the quantity of product taken up when the applicator is withdrawn.

Applicator pens, which are more practical to use, are also known. However, the performance of these pens is sometimes inferior to that which it is possible to obtain with complex shapes of known applicator end pieces that are produced by injection-molding or by machining a felt tip.

Patent application FR 2 933 281 discloses an applicator of elongate shape allowing the user to draw lines that are either thick or thin depending on the orientation of the end piece.

Patent application FR 2 971 923 describes various shapes of applicator comprising a cavity allowing cosmetic product be stored.

Patent application US 2006/249168 relates to an applicator of triangular or beveled shape.

Patent EP 1 229 810 discloses an applicator in the shape of an obtuse-angle triangle.

Finally, patent EP 1 623 650 discloses a flocked applicator made of a flexible material of triangular shape having a cavity for the retention of the cosmetic product.

There is a need for well-performing applicators that can be used to draw different lines depending on the orientation given to the applicator, and which are relatively easy to use and to manufacture.

The invention seeks to meet this need and achieves this by offering an applicator for applying a cosmetic product to human keratinous materials, comprising a stem extending along a longitudinal axis and an application member fixed to the stem, the application member comprising a body comprising a first and a second branch each extending away from the stem obliquely with respect to the longitudinal axis of the stem and diverging outward relative to one another, and being connected by a third branch at their end, this third branch extending obliquely with respect to the longitudinal axis of the stem, the first, second and third branches between them creating a cavity.

What is meant by "extending obliquely with respect to the longitudinal axis of the stem", is that the first, second and third branches of the application member have, in their distal portion, an axis that makes a non-zero angle other than 90° with the longitudinal axis of the stem, namely extend not parallel and not perpendicular to the longitudinal axis of the stem.

Preferably, the applicator member is molded in one piece.

Preferably, the angle formed by the first branch with the longitudinal axis of the stem differs from the angle formed by the second branch with the longitudinal axis of the stem.

The applicator member is preferably produced with an end piece for attachment to the stem, coaxial with this stem.

The stem is preferably rectilinear.

The angles of the branches are determined with respect to the longitudinal axis of the distal part of the stem. The angles of the branches may alternatively be determined relative to the axis of the end piece.

The cavity formed between the branches notably makes it possible to store cosmetic product and thus constitute a reservoir of cosmetic product so as to allow thick lines to be drawn without having to reload the applicator with product too frequently, for example by dipping it into a container containing a product, provided with a wiping member.

The applicator according to the invention allows lines to be drawn easily on the skin by moving the applicator across the skin or by dabbing the skin therewith.

The particular shape of the body, which is asymmetric with respect to the longitudinal axis of the stem, is highly ergonomic and makes it easy to modulate the thickness of the line during application. Specifically, depending on the orientation of the applicator, it is possible to obtain different effects and notably different line thicknesses.

The fact that the first and second branches are oblique with respect to the longitudinal axis of the stem, and, where appropriate, of the end piece when this is coaxial with the stem, allows good wiping of the applicator member as it passes through a wiping member.

Preferably, the applicator according to the invention is used for the application of eyeliner.

Preferably, the first, second and third branches are flexible. Thus, during wiping, the third branch moves closer to the first and/or the second branch, or may even be pressed against it (these), thereby allowing optimal wiping of the applicator member. In addition, the flexibility of the applicator member makes it easier to apply product to the skin because the applicator member can, because of its flexibility, more readily conform to the reliefs of the skin. The flexibility of the applicator member may also improve the gliding of the applicator over the skin, allowing a sharper and more precise line using the applicator and increased application comfort by avoiding dragging on the skin during application. The flexibility of the applicator member also allows uniform application of the cosmetic product.

Preferably, the body of the applicator member has a maximum width greater than the width of the end piece, and than the diameter of the stem. This makes it possible for the applicator member to be wiped more comprehensively in its regions of greatest width.

The third branch may form an angle of between 1° and 89°, preferably between 20° and 60°, and in particular close to 45° with the longitudinal axis of the stem. Too high an angle is likely to force the user to raise her arm in order to apply the cosmetic product using the third branch, making application less precise and more tiring for the user, whereas too small an angle tends to make application more difficult and less precise Preferably, the third branch defines a product application surface which is substantially planar. This tends to increase the amount of contact between the applicator member and the skin, which may improve the stability of the applicator member on the skin.

The first, second and third branches may be of different lengths. The third branch may be longer than at least one of the first and second branches.

Preferably, the cavity passes all the way through.

Preferably the cavity is of triangular shape, particularly in the shape of an obtuse-angle triangle, the obtuse angle being formed notably at the junction between the third branch and one of the first and second branches. The obtuse angle of the cavity may be between 90° and 150°, and more preferably between 90° and 135°, and in particular substantially equal to 115°. Such a triangular shape allows good retention of the cosmetic product and the obtuse nature of the angle makes it easier to pass through the wiping member as it encourages the branches to move closer together.

Preferably, the corners of the cavity, when the cavity is viewed face-on, are rounded. This makes it possible, during manufacture of the applicator, to make the molding thereof easier and facilitate the storage of cosmetic product in the cavity while at the same time allowing good restitution of the cosmetic product when the latter is being applied.

The cavity may have three sides of different sizes.

Preferably, the first and the second branch each have a width that decreases toward the third branch. The third branch may also have a width that decreases toward the free end of the applicator member. What is meant by "width" is the transverse dimension when viewed from the side, namely parallel to the plane defined by the branches. That makes it possible to have a body which is more flexible at its free end, thereby improving comfort during application. Furthermore, thanks to these measures, the body of the applicator member has a tapering free end, thereby improving precision of application. The triangular shape that the product application surface defined by the third branch exhibits also makes it possible to dab the "wing" in the outside corner of the eye when applying eyeliner. Finally, the widened base defined on the product application surface makes it possible to improve the stability of the application.

As an alternative, the third branch may also be of substantially constant width between its junctions with the first and second branches.

Preferably, the third branch has a planar product application surface extending toward the outside of the applicator member. Preferably, the planar application surface has rounded sides. Such roundings allow for more comfortable application and uniform application of the cosmetic product. Specifically, salient edges could, as the cosmetic product is being applied, scrape the cosmetic product already applied, thereby removing it or making the application imprecise.

Preferably, the junction of the first and of the second branch with the third branch is rounded. This improves the comfort of application of the applicator when the latter is in contact with the skin and, in particular, with the eyelids.

Preferably, the first and the second branch have a thickness that decreases toward their distal end. What is meant here by "thickness" is the transverse dimension when the applicator is viewed face-on, namely perpendicular to the plane defined by the branches.

Preferably, the applicator, notably the body of the applicator member, is provided with a flocked coating. This makes it possible to increase the autonomy of the applicator, complementing the cavity, and to improve the comfort of application, notably by the applicator feeling more gentle on the skin.

Alternatively, the device has no flocked coating.

Preferably, the applicator member is a monoblock component. The applicator member may be produced by injection-molding of thermoplastic material, notably thermoplastic elastomer (TPE).

A further subject of the invention is a packaging and application device comprising:

- a reservoir containing the cosmetic product, notably a makeup product, in particular an eyeliner, a product to be applied to the lips and/or to the eyebrows, an eyeshadow, or a mascara, preferably eyeliner,
- an applicator according to the invention, as defined above.

The cosmetic product may comprise one or more pigments, notably at least an iron oxide.

The container may be separable from the applicator. The stem may be mounted on a closure cap of the reservoir containing the product to be applied, such that the applicator tip can be inserted into the reservoir in order to be loaded with cosmetic product.

Preferably, the container comprises a wiping member designed to wipe the stem and the applicator member, notably comprising a wiping lip, the applicator member becoming deformed as it passes through the wiping member; in particular, the applicator member may be produced in such a way that the third branch moves closer to the first or the second branch, and preferably becomes pressed against the first or the second branch as the applicator member passes through the wiping member.

A further subject of the invention is a method for applying makeup to an eyelid, comprising the step consisting in drawing a line of cosmetic product on the skin using the applicator according to the invention, as described hereinabove.

The line being drawn by moving the applicator in contact with the skin or by dabbing the skin by successively placing the applicator in contact with and away from the skin.

The line obtained by applying the third branch to the skin, notably to the eyelid, while moving the applicator member parallel to the third branch, is a fine line, and the line obtained by applying the third branch to the skin while moving the applicator member perpendicular to the third branch is a thick line.

A further subject of the invention, according to a second of its aspects, is an eyeliner applicator comprising a stem and an applicator member fixed to the stem, the applicator member comprising:

- an end piece for fixing to the stem, extending along a longitudinal axis,
- an applicator head comprising a first and a second branch extending from the end piece, the first and second branches being joined to one another by a third branch that is oblique with respect to the longitudinal axis of the end piece, the first, second and third branches between them forming a cavity in the shape of an obtuse-angle triangle.

Preferably, the first and second branches each extend away from the stem obliquely with respect to the longitudinal axis of the stem.

Preferably, the angle formed by the first branch with the longitudinal axis of the end piece differs from the angle formed by the second branch with the longitudinal axis of the end piece.

One or several of the features described hereinabove in connection with the applicator according to the first aspect of the invention may be applied to the applicator according to this second aspect of the invention.

A further subject of the invention, according to another of its aspects, is an application device for applying a cosmetic product to human keratinous materials, comprising:

- a container (2) containing a product (P) to be applied,
- an applicator (3), comprising:
  - a stem (4), and
  - a molded applicator member (6) fixed to the stem (4) and able to be dipped into the container (2), the applicator member (6) comprising a body (20) comprising a first and a second branch (22; 24) each extending away from the stem obliquely with respect to the longitudinal axis of the stem and diverging outward from one another and being connected by a third branch (26) at their end, this third branch (26) extending obliquely with respect to the longitudinal axis (X) of the stem (4).

Preferably, the reservoir comprises a neck in which the applicator member is able to be inserted.

The container may comprise a wiper member, the applicator member being adapted to pass through the wiper member.

Preferably, the first and second branches extend, each at a distance from the rod, obliquely with respect to the longitudinal axis of the rod.

Preferably, the angle formed by the first branch with the longitudinal axis of the tip is different from the angle formed by the second branch with the longitudinal axis of the tip.

One or more of the features described above in connection with the applicator or the device according to the first aspect of the invention can be applied to the device according to this third aspect of the invention.

A further subject of the invention, according to a third of its aspects, is a packaging and application device comprising:

- a reservoir containing the cosmetic product, notably a makeup product, in particular an eyeliner, a product to be applied to the lips, an eyeshadow or a mascara, and comprising a wiping member comprising a wiping lip
- an applicator comprising a stem and an applicator member fixed to the stem, the applicator member comprising:
  - an end piece for fixing to the stem, extending along a longitudinal axis,
  - a body comprising a first and a second branch extending from the end piece and diverging outward, and being connected at their end by a third branch extending obliquely with respect to the longitudinal axis of the end piece, the first, second and third branches between them creating a cavity, the third branch moving closer to the first or the second branch, and preferably becoming pressed against the first or the second branch as the applicator member passes through the wiping member.

Preferably, the applicator member can be dipped into the container in order to become laden with cosmetic product.

Preferably, the reservoir comprises an opening into which the applicator member can be inserted.

The container may comprise a wiper member, the applicator member being adapted to pass through the wiper member.

Preferably, the first and second branches each extend away from the stem obliquely with respect to the longitudinal axis of the stem.

Preferably, the angle formed by the first branch with the longitudinal axis of the end piece differs from the angle formed by the second branch with the longitudinal axis of the end piece.

One or several of the features described hereinabove in connection with the applicator or the device according to the first aspect of the invention may be applied to the device according to this third aspect of the invention.

Figure 2:
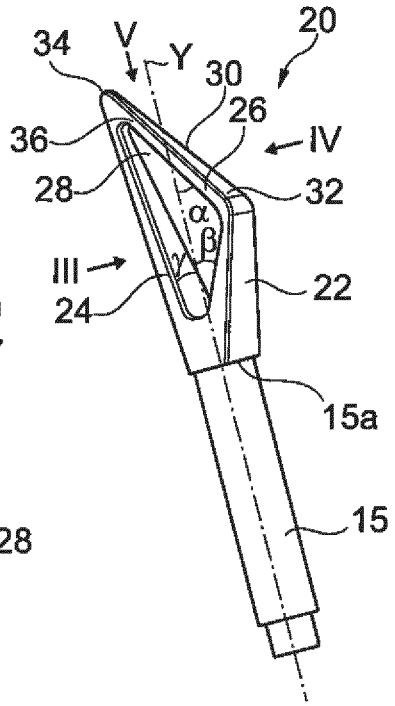
Figure 3:
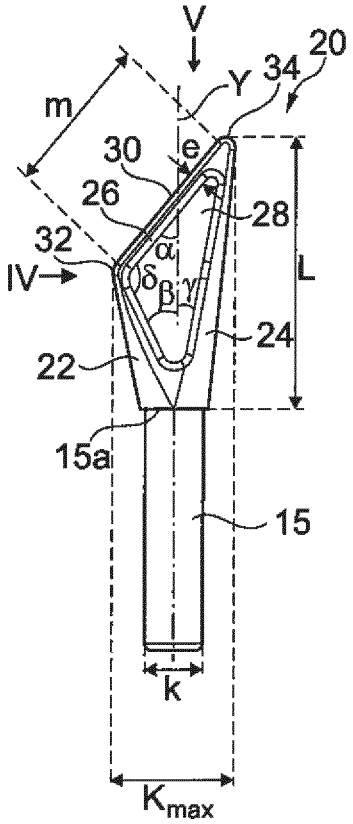
Figure 4:
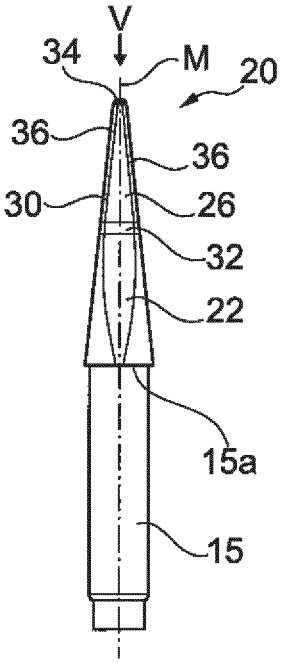
Figure 5:
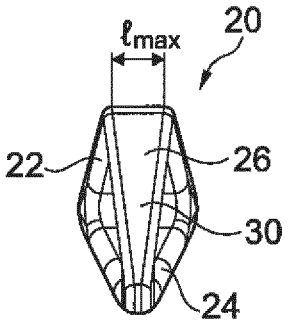
Figure 6:
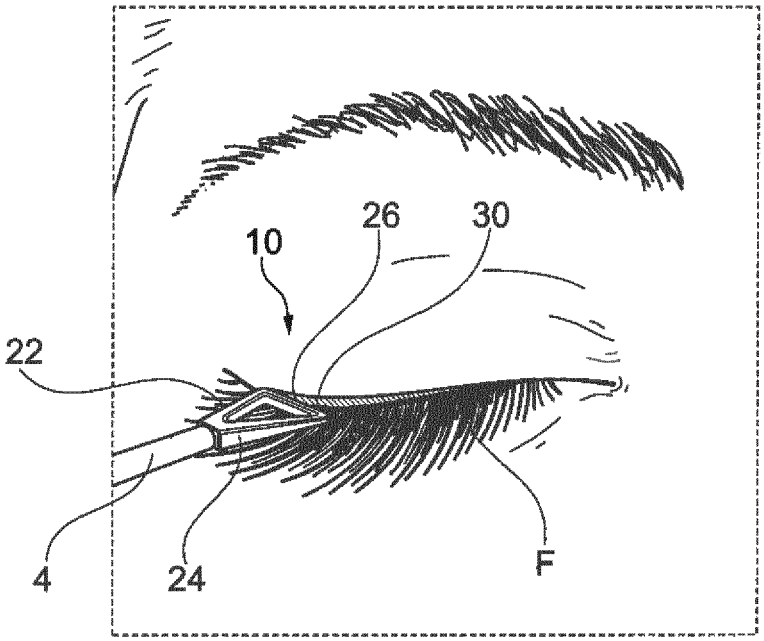
Figure 7:
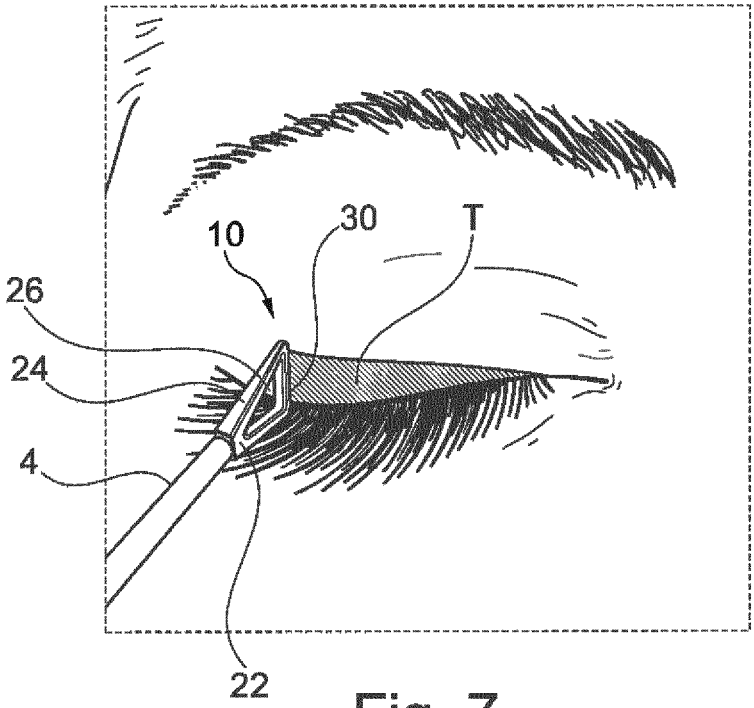
Figure 8:
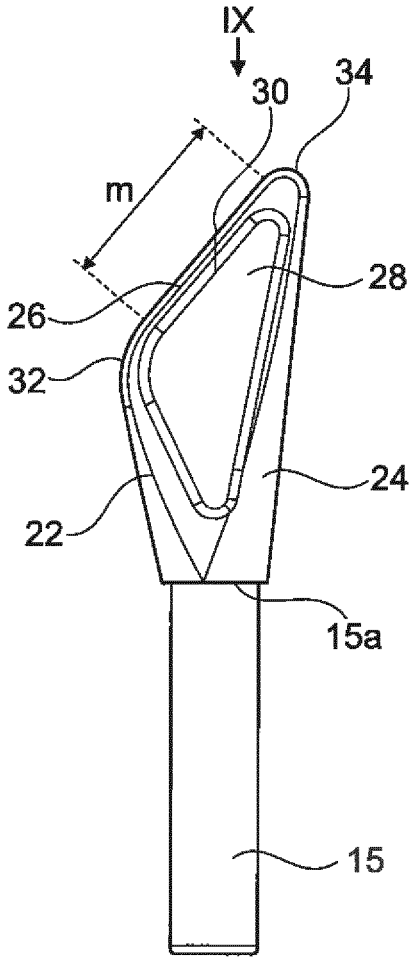
Figure 9:
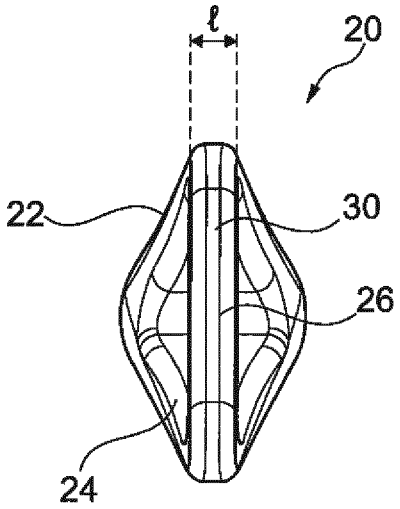

Further features and advantages of the present invention will become apparent from reading the following detailed description of nonlimiting illustrative embodiments thereof and from examining the appended drawing, in which:

FIG. 1 is a schematic and partial view, in longitudinal section, of an example of a packaging and application device produced in accordance with the invention, FIG. 2 is a perspective view of the application member of FIG. 1, FIG. 3 is a face-on view on III of FIG. 2, FIG. 4 is a view on IV of FIGS. 2 and 3, FIG. 5 is a view on V of FIGS. 2 to 4, FIGS. 6 and 7 illustrate alternative ways of applying eyeliner to the eyelid, FIG. 8 is perspective view of an alternative form of applicator member, and FIG. 9 is a view on IX of FIG. 8.

The packaging and application device 1 depicted in FIG. 1 comprises a container 2 containing a product P to be applied, and an applicator 3 comprising a stem 4 of longitudinal axis X, provided at a first end with a gripping member 5 that also constitutes a cap for sealed closure of the container 2, and at the other end with an applicator member 6.

The product P is an eyeliner in the example described, but it would not constitute a departure from the scope of the present invention if the product P were different, for example a care or makeup product for the lips or for the eyebrows, an eyeshadow or a nail varnish.

In the example illustrated, the longitudinal axis X of the stem 4 is rectilinear, but as an alternative it could be curved.

The container 2 is provided in the upper part with a neck 7 in which a wiping member 8 is engaged.

The gripping member 5 screws onto the neck 7 but could as an alternative be attached in some other way, for example by clipping on.

The wiping member 8 comprises a collar 9 resting against the upper edge face of the neck 7 and able to contribute to ensuring the sealed closure of the container 2, and a wiping lip 10 which in the example considered defines a wiping orifice 11 of circular cross section, of a diameter for example substantially equal to that of the stem 4.

The wiping member 8 may have a wiping lip that may or may not be wavy, may or may not be split, and may or may not be adjustable.

The user may load the applicator member 6 with product P by dipping it into the container 2 and then withdraw it by passing it through the wiping member 8.

In the example illustrated, the applicator member 6 comprises, as can be seen in FIGS. 2 to 5, an end piece 15 for fixing to the stem, extending along a longitudinal axis Y, which corresponds to the longitudinal axis X of the stem 4 when assembled thereto, and a body 20 having a first branch 22 and a second branch 24 extending from one end 15*a* of the end piece 15 and connected to one another at their distal end by an oblique third branch 26.

The body 20 has a maximum width $K_{max}$ greater than the width k of the end piece 15. The maximum width $K_{max}$ is preferably comprised between 1 mm and 8 mm, being here equal to approximately 4.5 mm.

The body 20 has a length L preferably comprised between 5 mm and 15 mm, being here equal to approximately 10 mm.

The first, the second and the third branch 22, 24 and 26 are rectilinear branches. As an alternative, the branches 22, 24 or 26 are curved, notably concave or outwardly convex.

The applicator member 6 in the example considered is molded as a single piece from a flexible material, notably a thermoplastic elastomer (TPE).

Because of the arrangement of the branches 22, 24 and 26, the applicator member 6 is asymmetric with respect to the longitudinal axis Y.

As can be seen in FIG. 4, the applicator member is preferably symmetric with respect to the plane M defined by the three branches 22, 24 and 26.

The third branch is oblique with respect to the longitudinal axis Y. It preferably forms therewith an angle α of between 1° and 89°, better between 20° and 60°, here equal to approximately 45°.

The first branch 22 forms an angle β that is oblique with respect to the longitudinal axis Y, preferably of between 1° and 60°, here equal to approximately 30°.

The second branch 24 forms an angle γ that is oblique with respect to the longitudinal axis Y, preferably of between 1° and 60°, here equal to approximately 15°.

The angles β and γ of the first and the second branch 22 and 24 are preferably different, notably the angle β of the first branch 22 is larger than the angle γ of the second branch 24. However, their relationship could be different, and in particular, the angles β and γ may be identical.

The first and the second branch 22 and 24 are, in the example considered, of different lengths. As an alternative, the first and the second branch 22 and 24 are of the same length, but make different angles β and γ with the longitudinal axis Y.

The third branch 26 may have a different length from the first and the second branch 22 and 24.

The three branches 22, 24 and 26 between them create a cavity 28.

The junction of, respectively, the first branch 22 and the second branch 24 with the third branch 26 may have a rounded portion 32, 34 respectively, improving comfort of application. The rounding 32 between the first branch 22 and the third branch 26 has a radius greater than that of the rounding 34 between the second branch 24 and the third branch 26. This makes it possible to combine both comfort of application and precision of application, notably by using the distal end formed by the rounded portion 34. In the example illustrated, the cavity 28 passes all the way through and has the shape of a triangle having an obtuse angle δ between the first branch 22 and the third branch 26 and having three sides of different sizes, each side being defined by one of the three branches 22, 24 and 26. The obtuse angle δ may be between 90° and 150°, preferably between 90° and 135°, here being equal to approximately 115°. The corners of the cavity 28 are rounded.

As can be seen in FIG. 3, the first and second branches 22 and 24 each have a thickness that decreases toward their end connected to the third branch 26. The third branch 26 preferably has a constant thickness e of, for example, between 0.2 mm and 2 mm, and notably equal to approximately 0.6 mm.

As can be seen in FIGS. 2 and 4, the first, the second and the third branch 22, 24 and 26 may have widths that decrease linearly toward the end of the applicator member 6.

As can be seen in FIGS. 2 and 5, the third branch 26 has a planar surface 30 allowing the cosmetic product to be applied to the skin. The planar surface 30 has a width l that decreases toward the distal end of the applicator. The maximum width $l_{max}$ of the planar surface 30 is for example between 0.1 mm and 5 mm, here being equal to approximately 1 mm. The planar surface 30 has rounded sides 36 for increased comfort of use and to prevent the edges of the planar surface 30 from removing cosmetic product at the same time as same is being applied.

The length m of the planar surface 30 is, for example, between 1 mm and 10 mm, here being between 5 mm and 6 mm, in particular equal to approximately 5.8 mm.

In the alternative form illustrated in FIGS. 8 and 9, the planar surface 30 has a constant width l between the junctions of the third branch 26 with the first and second branches 22, 24. This width l is for example between 0.1 mm and 5 mm, and preferably between 0.1 mm and 1 mm, in particular between 0.5 mm and 0.7 mm. The length m of the planar surface 30 here is between 4 and 5 mm, in particular equal to approximately 4.5 mm.

As the applicator member 6 is being withdrawn from the container 2, the first and third branches 22 and 26, particularly because of their flexibility, move closer to the second branch 24 and, in particular, the third branch presses against the second branch 24, through elastic deformation under the action of the wiping member 8, then return to their initial shape after they have passed through the wiping member 8.

Such an applicator makes it possible to create lines of different thicknesses. For example, as illustrated in FIG. 6, it is possible to draw a fine line F having, as its thickness, the dimension $l_{max}$ of the surface 30 by orienting the plane M parallel to the movement of application to the eyelid. Because of the variable width of the surface 30 it is also possible to form a fine point at the edge of the eye by using the tapered free end of the body of the applicator.

As illustrated in FIG. 7, it is possible to draw a thick line T having, as its maximum thickness, the length m of the surface 30 by orienting the plane M perpendicular to the direction of travel over the skin.

It is also possible to obtain lines of variable thickness, by turning the applicator member 6 during application.

The invention is not limited to the examples that have just been described.

In particular, the cavity may have another shape.

The surface 30 defined by the third branch 26 may bulge outward slightly.

The invention claimed is:

1. An application device for applying a cosmetic product to human keratinous materials, comprising:

a container containing a product to be applied, an applicator, comprising:

a stem, and a molded applicator member fixed to the stem and able to be dipped into the container, the applicator member comprising:

an end piece for fixing to the stem and an applicator head comprising a first and a second branch extending from one end of the endpiece, each first and second branch extending away from the stem obliquely with respect to the longitudinal axis of the stem and diverging outward from one another and being connected by a third branch at their end, this third branch extending obliquely with respect to the longitudinal axis of the stem, the first, second and third branches between them forming a cavity, the angle formed by the first branch with the longitudinal axis of the stem differing from the angle formed by the second branch with the longitudinal axis of the stem.

2. The applicator as claimed in claim 1, wherein the first and the second branch each have a width that decreases toward the third branch.

3. The applicator as claimed claim 1, wherein the first and the second branch each have a thickness that decreases toward their distal end.

4. The applicator as claimed in claim 1, the first, second and third branches being flexible.

5. The applicator as claimed in claim 1, wherein the body has a maximum width $K_{max}$ greater than the diameter of the stem.

6. The applicator as claimed in claim 1, wherein the third branch forms an angle α of between 1° and 890, with the longitudinal axis of the stem.

7. The applicator as claimed in claim 1, wherein the third branch defines a substantially planar application surface.

8. The applicator as claimed in claim 1, wherein the cavity is of triangular shape.

9. The applicator as claimed in claim 8, wherein an obtuse angle δ of the cavity is between 90° and 150°.

10. The applicator as claimed in claim 8, wherein the cavity has three sides of different sizes.

11. The applicator as claimed in claim 1, wherein the corners of the cavity when the cavity is viewed face-on, are rounded.

12. The device as claimed in claim 1, wherein the container comprising a wiping member is designed to wipe the stem and the applicator member, the applicator member becoming deformed as it passes through the wiping member.

13. A method for applying makeup to an eyelid, comprising: drawing a line of cosmetic product on the skin using the applicator as claimed in claim 1.

14. The method as claimed in claim 13, wherein the line obtained by applying the third branch to the skin while moving the applicator member parallel to the third branch is a fine line, and the line obtained by applying the third branch to the skin while moving the applicator member (6) perpendicular to the third branch is a thick line.

15. The device as claimed in claim 1, wherein the applicator member is produced in such a way that the third branch moves closer to the first or the second branch as the applicator member passes through the wiping member.

16. An applicator for applying a cosmetic product to human keratinous materials, comprising: a stem and an applicator member fixed to the stem, the applicator member comprising a body comprising a first and a second branch each extending away from the stem obliquely with respect to the longitudinal axis of the stem and diverging outward from one another and being connected by a third branch at their end, this third branch extending obliquely with respect to the longitudinal axis of the stem, the first, second and third branches between them forming a cavity, the first and the second branch each having a width and/or thickness that decreases toward the third branch.

17. The applicator as claimed in claim 16, wherein the angle formed by the first branch with the longitudinal axis of the stem is different from the angle formed by the second branch with the longitudinal axis of the stem.

18. A device for applying eyeliner, comprising:

a reservoir containing a cosmetic product to be applied, and an applicator as claimed in claim 16.

* * * * *